US005794858A

United States Patent [19]

Munoz

[11] Patent Number: 5,794,858

[45] Date of Patent: Aug. 18, 1998

[54] QUICK ASSEMBLY WATERJET NOZZLE

[75] Inventor: Jose P. Munoz, Brighton, Mich.

[73] Assignee: Ingersoll-Rand Company, Woodcliff Lake, N.J.

[21] Appl. No.: 655,066

[22] Filed: May 29, 1996

[51] Int. Cl.[6] ..... B05B 7/14; B05B 7/28

[52] U.S. Cl. ..... 239/433; 239/600; 51/439

[58] Field of Search ..... 239/600, 433; 451/102; 83/177

[56] References Cited

U.S. PATENT DOCUMENTS

| | | | |
|---|---|---|---|
| 4,478,368 | 10/1984 | Yie | 239/600 X |
| 4,494,735 | 1/1985 | Hershey | 239/600 X |
| 4,817,874 | 4/1989 | Jerzebowicz | 239/600 X |
| 4,832,266 | 5/1989 | Marvin | 451/102 X |
| 4,872,615 | 10/1989 | Myers | 239/600 X |
| 5,054,249 | 10/1991 | Rankin | 451/102 X |
| 5,092,085 | 3/1992 | Hashish et al. | 451/102 |
| 5,255,853 | 10/1993 | Munoz | 451/102 X |
| 5,320,289 | 6/1994 | Hashish et al. | 239/600 X |
| 5,335,459 | 8/1994 | Dale | 451/102 |

*Primary Examiner*—Lesley D. Morris
*Attorney, Agent, or Firm*—Walter C. Vliet; Leon Nigohosian, Jr.

[57] ABSTRACT

A separable nozzle body is provided in a quick change assembly including a feed tube handle making change possible without the use of tools, the separable nozzle body having included and aligned therein all the nozzle wear components.

10 Claims, 4 Drawing Sheets

QUICK ASSEMBLY WATERJET NOZZLE

BACKGROUND OF THE INVENTION

This invention relates generally to fluid jet cutting apparatus and more particularly to a waterjet nozzle assembly with quick change features. The nozzle assembly to which this invention pertains commonly comprise a nozzle body, a nozzle tube, a jet orifice element, a wear insert, and a focusing tube, the elements being generally centrally bored and disposed for longitudinal alignment of the bores substantially along an axis. In normal operation the jet nozzle, the wear insert, and the focusing tube occasionally require replacement. In the prior art this required complete disassembly of the nozzle requiring the use of tools and the need for disconnecting the nozzle tube and abrasive inlet hoses connected to the nozzle body.

The foregoing illustrates limitations known to exist in present devices and methods. Thus, it is apparent that it would be advantageous to provide an alternative directed to overcoming one or more of the limitations set forth above. Accordingly, a suitable alternative is provided including features more disclosed hereinafter.

SUMMARY OF THE INVENTION

In one aspect of the present invention this is accomplished by providing a quick assembly waterjet nozzle including a nozzle cap having an axial cap bore therethrough; a nozzle tube threadingly engaged in one end of the axial cap bore; a nozzle body inserted and retained in another end of the axial cap bore; the nozzle body being further provided with an axial nozzle body bore; an orifice aligned in one end of the nozzle body bore; and nozzle body being further provided with an axial locking means and a means for rotation indexing within the nozzle body bore.

The foregoing and other aspects will become apparent from the following detailed description of the invention when considered in conjunction with the accompanying drawing figures.

BRIEF DESCRIPTION OF THE DRAWING FIGURES

DETAILED DESCRIPTION

Figure 9:
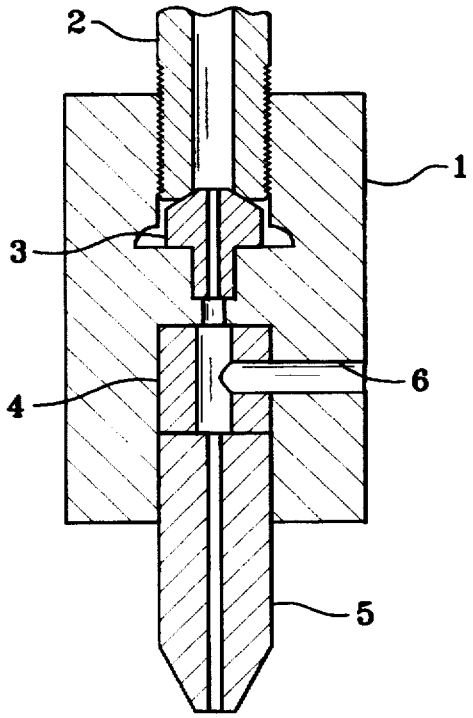
FIG. 9 (PRIOR ART)
FIG. 9 is a cross section of the prior art showing typical construction features of the prior art.

Referring first to FIG. 9 for understanding of the prior art, a typical prior art nozzle assembly comprises a nozzle body containing a number of interconnected central bores into which the various components of the nozzle were assembled. For example, a nozzle tube 2, an orifice 3, a wear insert 4, and a focusing tube 5. In the case of abrasive waterjet cutting, an abrasive inlet 6 was provided to permit the abrasive particles to enter the waterjet stream emanating from the orifice and directed through the focusing tube 5 to the work piece being cut. The wear insert minimized damage to the nozzle body. In use the orifice, wear insert and focusing tube require frequent replacement.

To accomplish this in the prior art it was necessary to disassemble the nozzle body from the nozzle tube and the connections to the abrasive inlet. The individual components were then disassembled from the nozzle body and replaced. This was relatively time-consuming and interfered with production rates. Further, it required the use of tools and required some skill in assuring the proper orientation and alignment of the various components upon reassembly. The present invention overcomes a number of the prior art disadvantages as will now be described.

Figure 1:
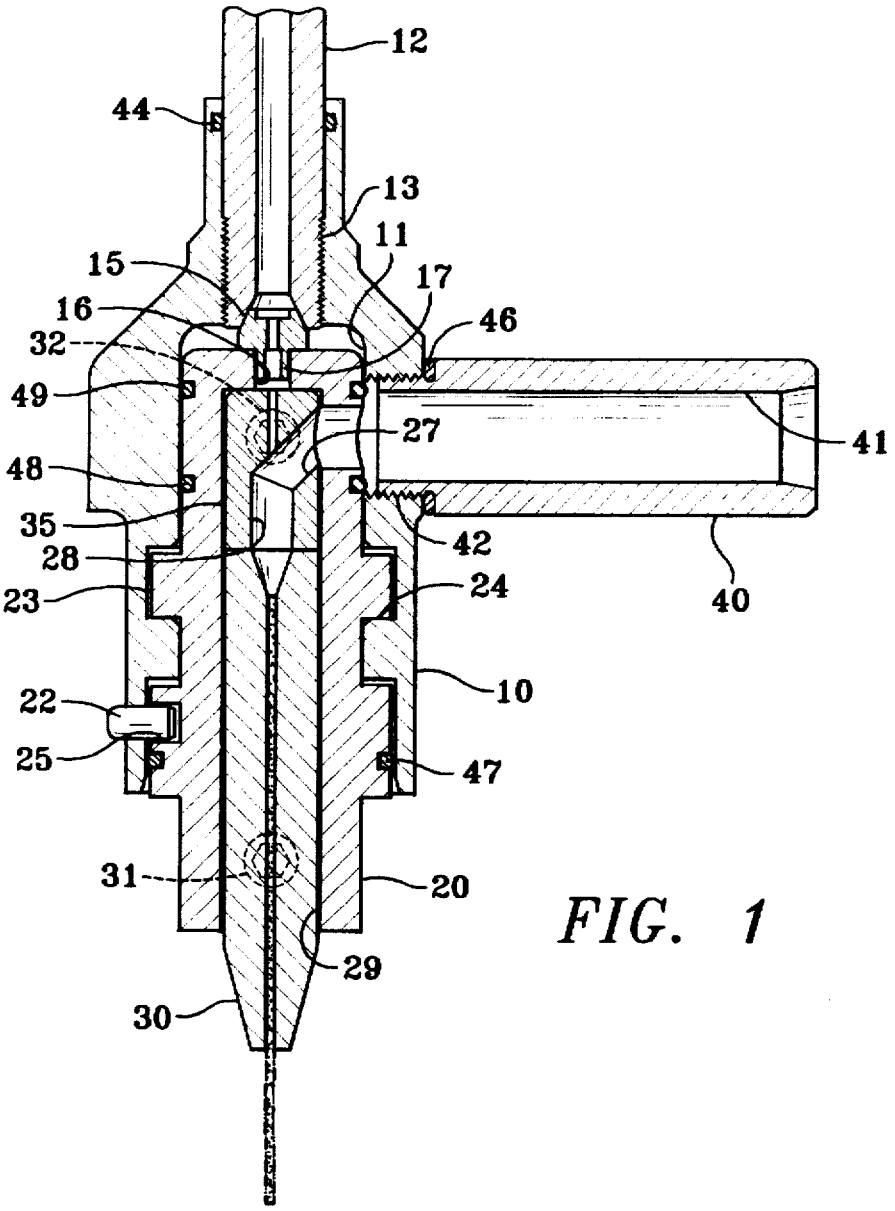
FIG. 1 is a cross section elevation view of a quick assembly waterjet nozzle according to the present invention.

Referring to FIG. 1, a quick change nozzle assembly according to the present invention is shown in cross section. The assembly comprises a stepped cylindrical shaped nozzle cap 10 having an axial cap bore 11 therethrough. A nozzle tube 12 is inserted in one end of the axial cap bore 11 and retained therein by means of a thread 13. The nozzle tube 12 is in sealing engagement with the axial cap bore 11 by means of an "O" ring 44. Inserted in the opposite end of the axial cap bore 11 from the nozzle tube end is a nozzle body 20. The nozzle body 20 is further provided with a nozzle body bore 29 into which is inserted a focus tube 30 and a wear insert 35. The focus tube 30 and the wear insert 35 are retained within the nozzle body bore 29 by means of set screws 31 and 32 respectively. The nozzle body 20 is further retained within the axial cap bore 11 by means of an interlocking step 23 on the nozzle body 20 and a locking land 24 on the nozzle cap 10.

Figure 8:
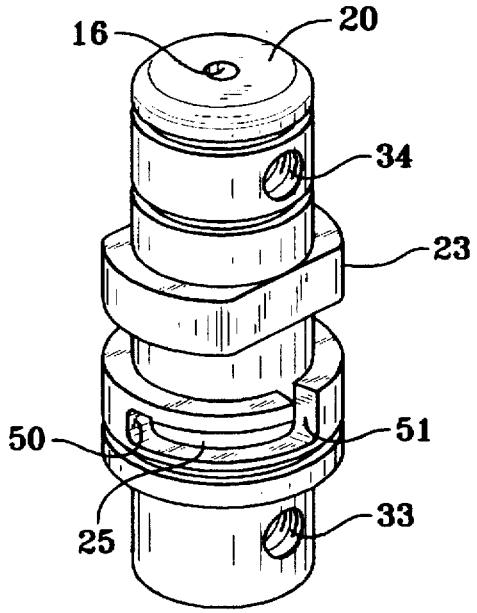
FIG. 8 is a pictorial view of the nozzle body according to the present invention.

Orientation of the nozzle body 20 in the axial cap bore 11 is accomplished by means of a guide pin 22 which cooperates with a guide groove 25 (best seen in FIG. 8). The guide pin 22 and the guide groove 25 cooperate to align the abrasive inlet in the wear insert 35 with the abrasive inlet bore 41 contained in feed tube handle 40. An orifice 15 is disposed in a small longitudinal orifice bore 16 within the nozzle body 20 for alignment purposes and is compressed for retention between the nozzle body 20 and the nozzle tube 12.

Sealing of the various components is accomplished by means of a number of "O" rings, in particular "O" ring 44 seals the nozzle tube in the threaded bore 13, "O" ring 46 is used to seal the threaded connection between the handle 40 and the nozzle cap 10, "O" ring 47 seals the other end of the axial cap bore 11 and the nozzle body, and a pair of "O" rings 48, 49, seal the abrasive inlet within the axial cap bore 11.

Figure 2:
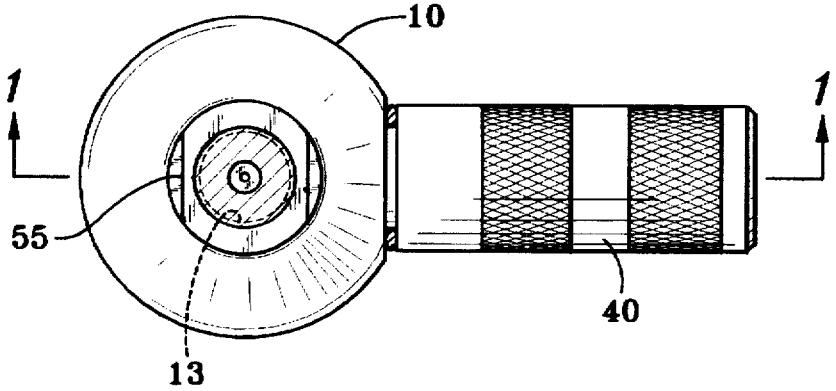
FIG. 2 is a top end view of the waterjet nozzle.
Figure 3:
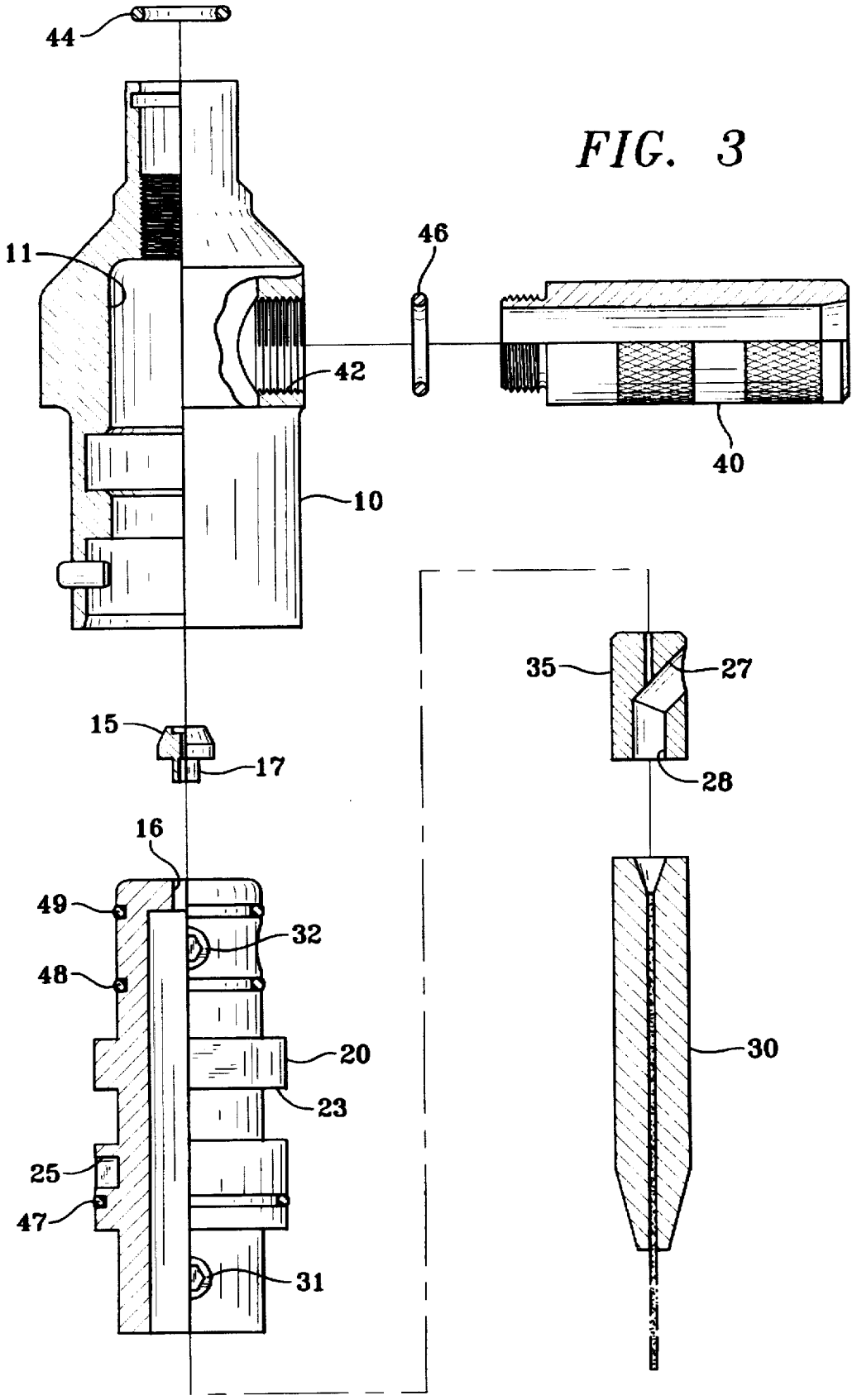
FIG. 3 is a partially sectioned exploded assembly view of the nozzle according to the present invention.
Figure 4:
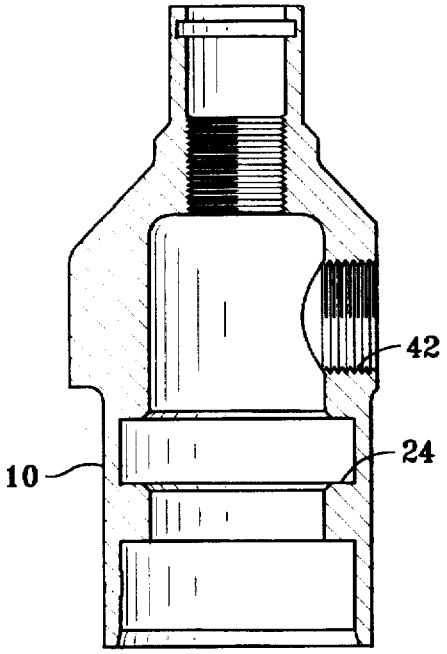
FIG. 4 is a cross section of the nozzle cap according to the present invention.
Figure 5:
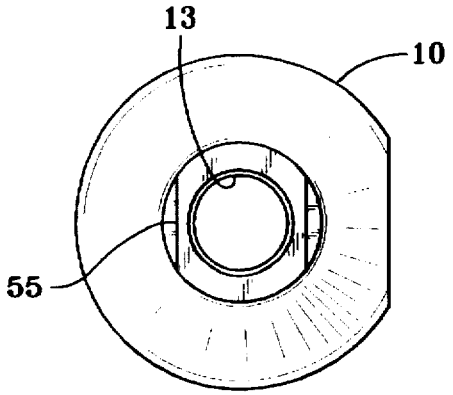
FIG. 5 is a bottom end view of the nozzle cap.
Figure 6:
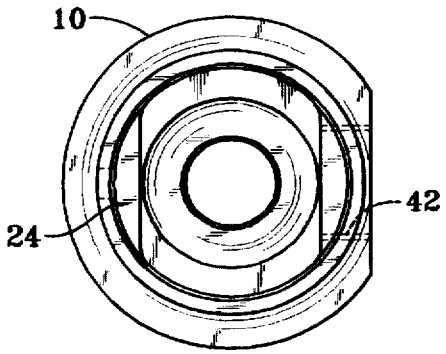
FIG. 6 is a top end view of the nozzle cap according to the present invention.
Figure 7:
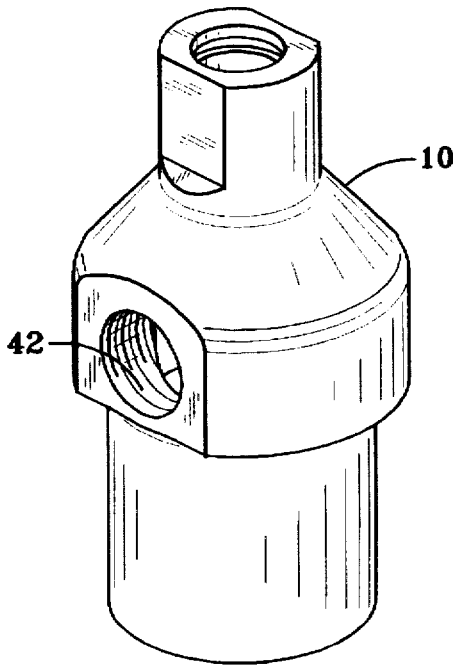
FIG. 7 is a pictorial overview of the nozzle cap according to the present invention.

As may be appreciated by one skilled in the art the handle 40, as best seen in FIG. 1 and 2, may be used to rotate the nozzle about the nozzle tube 12. A wrench flat 55 may also be provided for this purpose but in the preferred embodiment the handle 40 may preferably be used as a means of rotation. FIG. 3 shows the assembly of components for the nozzle.

In operation, the nozzle tube is normally fixed on an X-Y computer controlled carrier or the like and the nozzle cap 10 is screwed onto the nozzle tube by means of the thread 13. The handle 40, which contains the abrasive inlet bore 41, is attached to the nozzle body by means of a threaded connection 42. Referring to FIGS. 1 through 8, to replace the nozzle components it is simply necessary to rotate the nozzle cap 10 by means of the handle thereby backing the nozzle tube 12 slightly out of the threaded bore 13. As best seen in FIG. 8, this permits the nozzle body 20 to be rotated within the axial cap bore 11 from the locked position 50 in the guide groove 25 to the unlocked and release channel position 51 in the guide groove as controlled by the guide pin 22.

In the unlocked position the locking step 23 can clear the locking lands 24 of the nozzle cap permitting the nozzle body 20 to be removed. Once the nozzle body 20 is removed the orifice 15 may be replaced in the orifice bore 16. If it is desirable to replace the focus tube 30 and/or the lock wear insert 35, the set screws 31 and 32 may be backed out of their respective threaded bores 33 and 34. This permits the focus tube and the wear insert to be removed from the nozzle body bore 29. The design of the nozzle body 20 permits assembly of the orifice 15 on the external top surface by insertion of the nozzle stem 17 into orifice bore 16. This eliminates the need to fumble with alignment and insertion of the small nozzle part in a recess as is common in the prior art.

To reassemble the nozzle, the wear insert 35 is inserted in the nozzle body bore 29 and is aligned with the abrasive inlet 27 facing the abrasive inlet bore 41. The focus tube is then inserted and clamped in place by means of the set screws 31 and 32. The nozzle body 20 may then be reinserted in the nozzle cap 10 by simply aligning the guide groove 25, release point 51, with the guide pin and inserting the nozzle body into the nozzle cap.

Once fully inserted, as controlled by the guide groove, the nozzle body 20 may be rotated to the lock position as controlled by the lock point 50 in guide groove 25. The locking step 23 with locking land 24 to secure the nozzle body 20 within the nozzle cap 10. The handle 40 may then be utilized to rotate the nozzle cap to increasingly threadingly engage the nozzle tube 12 thereby clamping the orifice 15 securely between the nozzle tube and the nozzle body.

It should be appreciated that in order to save considerable time in the replacement of the nozzle parts, a spare nozzle body may be assembled which may be rapidly inserted in the nozzle cap as previously described. One skilled in the art can appreciate that the nozzle structure taught by the present invention accomplishes both the task of replacement and ready alignment of the nozzle components with minimal effort and time.

Having described my invention in terms of a preferred embodiment, I do not wish to be limited in the scope of my invention as other variations may occur to one skilled in the art except as claimed.

What is claimed is:

1. A quick change nozzle assembly for waterjet cutting comprising:

a nozzle cap having an axial cap bore therethrough;

a nozzle tube threadingly engaged in one end of said axial cap bore;

a nozzle body inserted and retained in another end of said axial cap bore;

said nozzle body being further provided with a longitudinal orifice bore and an axial nozzle body bore connected to and having a larger diameter than said longitudinal orifice bore;

an orifice having a nozzle stem disposed in one end of said longitudinal orifice bore;

said nozzle body being further provided with an axial locking means and a means for rotation indexing within said axial cap bore.

2. A quick change nozzle assembly for waterjet cutting according to claim 1, wherein:

said axial locking means further comprises a locking step formed on said nozzle body and an interlocking locking land formed in said axial cap bore.

3. A quick change nozzle assembly for waterjet cutting according to claim 2, wherein:

said locking step and said locking land are interlocking in one relative rotary position between said nozzle cap and said nozzle body to prevent separation of said nozzle cap and said nozzle body and said locking step and said locking land are positioned to pass each other in a second relative rotary position between said nozzle cap and said nozzle body to permit separation and removal of said nozzle body from said nozzle cap.

4. A quick change nozzle assembly for waterjet cutting according to claim 2, wherein:

said means for rotation indexing further comprises a guide pin in said axial cap bore cooperating with a guide groove on said nozzle body.

5. A quick change nozzle assembly for waterjet cutting according to claim 4, wherein:

said guide groove is provided with a lock point engaged in said one relative rotary position by said guide pin and a release channel in said second relative rotary position for release of said guide pin to further permit separation.

6. A quick change nozzle assembly for waterjet cutting according to claim 1, wherein:

said nozzle body and said nozzle cap are provided with an aligned abrasive inlet.

7. A quick change nozzle assembly for waterjet cutting according to claim 1, wherein:

said nozzle body is further provided with a nozzle body bore having a wear insert and a focus tube inserted therein.

8. A quick change nozzle assembly for waterjet cutting according to claim 7, wherein:

said insert and said focus tube are removable from said nozzle body bore.

9. A quick change nozzle assembly for waterjet cutting according to claim 1, wherein:

said orifice is inserted in an external surface end of said nozzle body in said one end of said nozzle body bore.

10. A quick change nozzle assembly for waterjet cutting comprising:

a nozzle cap having an axial cap bore therethrough;

a nozzle tube threadingly engaged in one end of said axial cap bore;

a nozzle body inserted and retained in another end of said axial cap bore;

said nozzle body being further provided with an axial nozzle body bore;

an orifice aligned in one end of said nozzle body bore;

said nozzle body being further provided with an axial locking means and a means for rotation indexing within said axial cap bore; and said nozzle body and said nozzle cap are further provided with an aligned abrasive inlet having a projecting abrasive feed tube forming a handle means for rotating said nozzle cap to said nozzle tube.

* * * * *